United States Patent [19]

Haenni et al.

[11] Patent Number: 4,515,050

[45] Date of Patent: May 7, 1985

[54] APPARATUS FOR FEEDING SHEET METAL PLATES TO A SHEET SHEAR ARRANGEMENT

[75] Inventors: Eduard Haenni; Theo Frei, both of Zofingen; Peter Hug, Safenwil, all of Switzerland

[73] Assignee: Hämmerle AG Maschinenfabrik, Zofingen, Switzerland

[21] Appl. No.: 547,583

[22] Filed: Nov. 1, 1983

[30] Foreign Application Priority Data

Nov. 9, 1982 [CH] Switzerland ..... 6488/82

[51] Int. Cl.[3] ..... B23D 33/02; B21D 43/11

[52] U.S. Cl. ..... 83/71; 83/104; 83/281

[58] Field of Search ..... 83/71, 104, 105, 281

[56] References Cited

U.S. PATENT DOCUMENTS

| | | | |
|---|---|---|---|
| 2,627,890 | 2/1953 | Lloyd | 72/27 |
| 3,650,133 | 3/1972 | Bredow | 83/409 X |
| 3,717,061 | 2/1973 | Daniels | 83/409 |
| 3,830,121 | 8/1974 | Makeev et al. | 83/104 X |
| 3,877,332 | 4/1975 | Roch | 83/71 X |
| 4,040,318 | 8/1977 | Makeev et al. | 83/71 |
| 4,162,641 | 7/1979 | Stubbings | 83/281 X |
| 4,297,927 | 11/1981 | Kuroda | 83/36 |
| 4,361,062 | 11/1982 | Reiff | 83/281 X |
| 4,407,628 | 10/1983 | Pearson et al. | 83/104 X |

FOREIGN PATENT DOCUMENTS

| | | |
|---|---|---|
| 2308419 | 2/1973 | Fed. Rep. of Germany . |
| 3010062 | 9/1981 | Fed. Rep. of Germany . |
| 3040446 | 5/1982 | Fed. Rep. of Germany . |
| 2234083 | 6/1973 | France . |
| 2350902 | 5/1976 | France . |
| 2424786 | 5/1979 | France . |
| 2477929 | 3/1981 | France . |

*Primary Examiner*—Donald R. Schran

*Attorney, Agent, or Firm*—Werner W. Kleeman

[57] ABSTRACT

Sheet metal plates are automatically fed for processing to a computerized numerically controlled sheet shear arrangement by means of the feeding apparatus. This feeding apparatus comprises a feeding bar arranged parallel to the cutting blades of the sheet shear arrangement and movable perpendicular thereto. Elevationally displaceable or movable holding elements are arranged on opposite sides of the feeding bar. On the side of the cutting blades the holding elements retain a first sheet metal plate intended to be cut and on the opposite side grip a second sheet metal plate which has been elevated by suction elements. During the cutting operation performed upon the first sheet metal plate the second sheet metal plate is drawn to a working table within an overlapping time interval and placed upon the working table. After sectioning the first sheet metal plate the second sheet metal plate bearing upon the working table is pressed against stops located on the rear side of the working table conjointly with the rearward movement of the empty feeding bar. Subsequently the second sheet metal plate is gripped by the holding elements on the cutting blade side of the feeding bar and the same operation starts anew. In addition to the described automatic sheet metal feeding operation downwardly pivotable and weight-balanced working tables permit access to the sheet shear arrangement for performing conventional manual cutting operations in case special sections or blanks should be cut or small series of blanks or sections should be cut.

11 Claims, 4 Drawing Figures

APPARATUS FOR FEEDING SHEET METAL PLATES TO A SHEET SHEAR ARRANGEMENT

CROSS-REFERENCE TO RELATED APPLICATION

This application is related to the commonly assigned, copending U.S. application Ser. No. 06/461,934, filed Jan. 28, 1983, entitled "APPARATUS FOR OUT-FEEDING AND STACKING OF SHEET METAL SECTIONS OR CUTTINGS OR THE LIKE".

BACKGROUND OF THE INVENTION

The present invention relates to a new and improved apparatus for feeding sheet metal plates or panels or the like to a sheet shear arrangement, especially a computerized numerically controlled sheet shear arrangement.

In its more specific aspects the invention relates to a new and improved apparatus for feeding sheet metal plates or the like to an especially computerized numerically controlled sheet shear arrangement, comprising a working table arranged in front of the sheet shear arrangement and a feeding bar or beam arranged parallel to the cutting blades of the sheet shear arrangement which is reciprocatingly movable perpendicular to the cutting blades and longitudinally of the working table by means of driven pinion meshing with stationary toothed racks. The feeding bar or beam has a side facing the cutting blades where there are arranged holding elements equipped with lifting devices.

In an apparatus for feeding sheet metal plates to a sheet shear arrangement as known, for example, from German Patent Publication No. 3,010,062, clamping tongs and/or vacuum suction elements serve to grip and feed a sheet metal plate to the sheet shear arrangement. The feeding apparatus is provided with programming equipment for the numerical control thereof. On the side facing the cutting blades or cutters of the sheet sheer arrangement the clamping tongs are mounted to be vertically displaceably at a slide which is guided at two parallel sliding bars which are arranged perpendicular to the cutting blades. The slide is reciprocatingly displaced perpendicular to the cutting blades by means of two pinions driven by an associated driving unit. Each of the pinions mesh with a respective one of two stationarily arranged toothed racks arranged adjacent and parallel to the sliding bars. A lifting and rotating device containing vacuum suction elements are provided on the side of the slide which is remote from the cutting blades or cutters. A sheet metal stack placed on a lifting apparatus in front of the working table is passed over by the lifting and rotating device of the slide during operation of the feeding apparatus, in order to lift one sheet metal plate from the stack by means of the vacuum suction elements. The sheet metal plate carried by the vacuum suction elements is fed to the sheet shear arrangement and trimmed on all sides. After the last trimming cut the sheet metal plate is engaged by the clamping tongs for further processing. Up to a certain residual width sections also can be formed at a sheet metal plate which is carried by the vacuum suction elements, only the residual or remaining strip of the sheet metal plate being gripped by the clamping tongs for the further processing operation.

Disadvantages of the aforementioned state-of-the-art sheet metal plate feeding apparatus reside in the same being unsuited for processing heavy sheet metal plates, since the vacuum suction elements must take-up the entire weight of the sheet metal plate for the transport from the stack to the sheet shear arrangement. It is a further disadvantage that a sheet metal plate cannot be placed upon the working table within an overlapping time interval during which a previously taken-up sheet metal plate is being trimmed or cut. Furthermore, it is also a disadvantage in the known feeding apparatus that the same is unsuitable for conventional manual cutting operations for small cutting series or cutting of special sections or blanks.

SUMMARY OF THE INVENTION

Therefore, with the foregoing in mind it is a primary object of the present invention to provide a new and improved construction of feeding apparatus for feeding sheet metal plates to a sheet shear arrangement which enables even heavy sheet metal plates to be placed upon the working table within an overlapping time interval during the processing of a first sheet metal plate.

Another important object of the present invention is directed to the provision of a new and improved construction of an apparatus for feeding sheet metal plates to a sheet shear arrangement, which additionally is capable of being readily modified or prepared for special sections or small cutting series by performing conventional manual cutting operations.

Now in order to implement these and still further objects of the invention, which will become more readily apparent as the description proceeds, the feeding apparatus of the present development is manifested by the features that, elevatable or elevationally displaceable holding elements designed to grip an edge of the sheet metal plates are arranged on the side of the feeding bar or beam which is located remote from the cutting blades or cutters, and the working table comprises at least two stationary tables and at least one downwardly pivotable table secured to at least one intermediate support.

Some of the more notable advantages achieved by the feeding apparatus according to the invention are essentially that the same feeding means which are used to position the sheet metal plate to be cut also serve to supply the further sheet metal plates. By appropriately designing and controlling the holding elements it is possible to place a further sheet metal plate upon the working table within an overlapping time interval, i.e. during cutting of the first-mentioned sheet metal plate. The possibility of positioning displaceable feeding means immediately in front of the cutting blades or cutters of the sheet shear arrangement and downwardly pivoting at least one working table in a most simple manner and without any great effort for achieving free access to the equipment, permits the sheet shear arrangement to be also used for performing conventional and manual cutting operations.

BRIEF DESCRIPTION OF THE DRAWINGS

The invention will be better understood and objects other than those set forth above, will become apparent when consideration is given to the following detailed description thereof. Such description makes reference to the annexed drawings wherein throughout the various Figures of the drawings there have been generally used the same reference characters to denote the same or analogous components, and wherein.

DETAILED DESCRIPTION OF THE PREFERRED EMBODIMENTS

Figure 1:
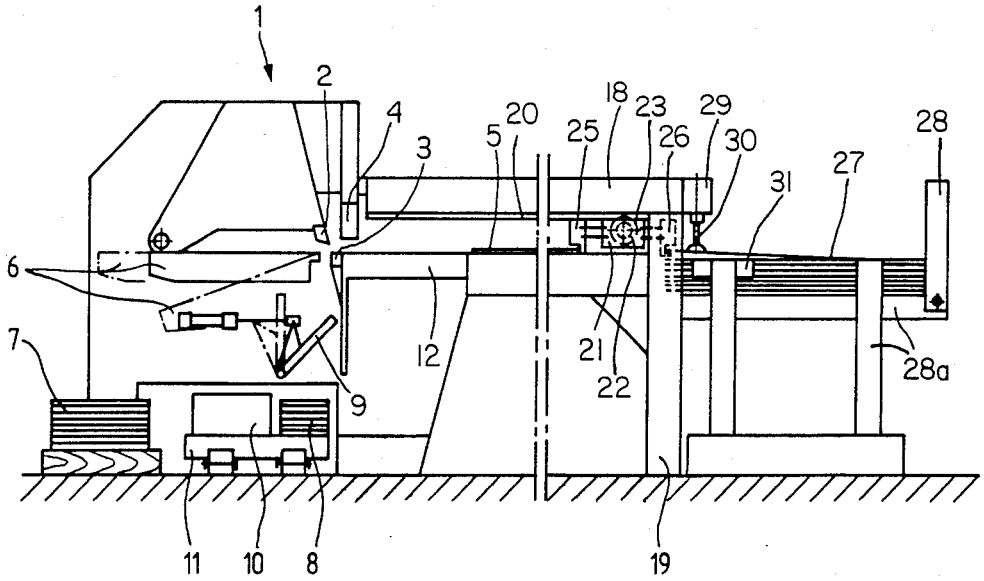
FIG. 1 is a schematic side elevational view of the inventive apparatus conveniently depicted in a shortened representation.
Figure 2:
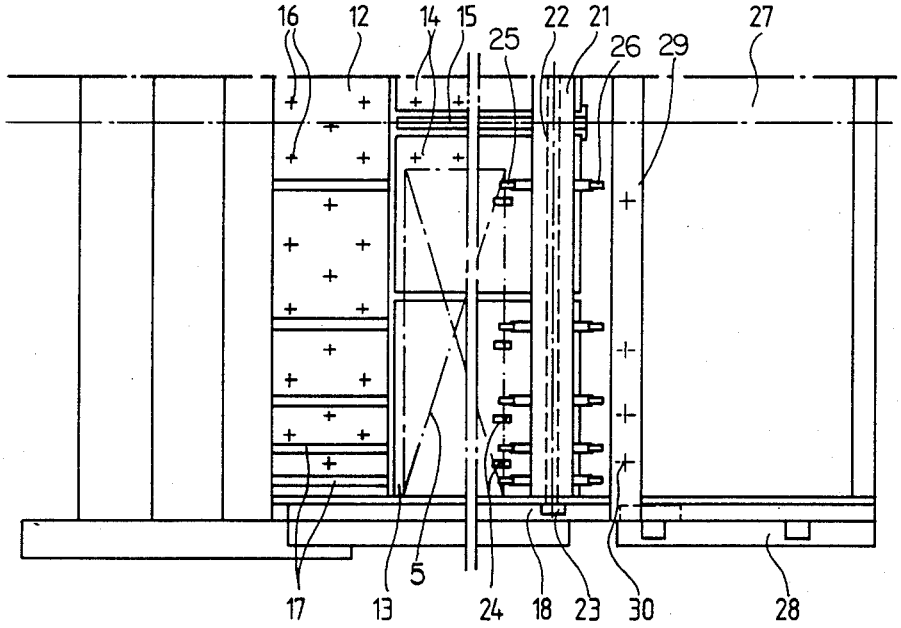
FIG. 2 is a top plan view portrayed in a shortened and schematic illustration of approximately one-half of the feeding apparatus shown in FIG. 1.

Describing now the drawings, it is to be understood that only enough of the construction of the exemplary embodiment of feeding apparatus has been shown as needed for those skilled in the art to readily understand the underlying principles and concepts of the present development, while simplifying the showing of the drawings. Turning attention now specifically to FIG. 1, there has been schematically illustrated therein a hydraulic sheet or panel shear or cutter arrangement, generally designated by reference character 1. The sheet shear or cutter arrangement 1 comprises an upper cutting blade or cutter 2, a lower cutting blade or cutter 3 and a panel or plate holding-down or holddown element 4. The sheet shear or cutter arrangement 1 serves for cutting sheet metal plates or panels 5 or the like. To the rear of the cutting blades or cutters 2, 3, as seen in the plate feeding direction, there are arranged a downwardly pivotable and horizontally displaceable supporting table 6 and a stacking location or station 7 for larger sheet metal sections or cuttings and a stacking location or station 8 for sheet metal strips. A diverter element, for instance a flap 9 conducts waste or scrap sheet metal to a scrap metal container 10. The scrap metal container 10 and the stacking location or station 8 rest upon a transport carriage 11 which can be driven out or moved laterally from the sheet shear or cutter arrangement 1.

Directly in front of the cutters or cutting blades 2, 3 there is located a stationary working table 12. Adjacent the working table 12 but on the side thereof which is remote from the cutters or cutting blades 2, 3 there are laterally arranged two stationary table members 13 and two downwardly pivotable or tiltable table members 14. The downwardly pivotable or tiltable table members 14 are secured to at least one intermediate support or supporting member 15 by means of conventional hinges or the like. On their other side the downwardly pivotable or tiltable table members 14 bear upon not particularly shown pawls or latches which are mounted at the stationary table members 13. The upper surface of the working table 12 and that of the adjacent table members 13, 14 are equipped with ball elements 16 or the like upon which roll the sheet metal plate or panel 5 which is to be cut. Additionally, grooves or channels 17 are arranged in the stationary working table 12.

On each side or end of the working table 12 there is arranged a lateral beam 18, the front end of which is appropriately connected to the sheet shear or cutter arrangement 1 and the rear end of which is connected to a base member 19 of the neighboring stationary table member 13. A toothed rack 20 or equivalent structure is secured below each lateral beam 18 and simultaneously serves as a guideway or guide track. A stable or solid feeding bar or beam 21 interconnects the two lateral beams 18 and is guided along the guideway by means of roller guiding means. At one end of the feeding bar 21 there is arranged a suitable transmission drive motor which is not shown in any particular detail, which serves to drive the feeding bar or beam 21 by means of a shaft 22 and two pinions 23 which mesh with the toothed racks 20. At the ends of the table members 13, 14 which are located remote from the cutters or cutting blades 2, 3 there are provided spring-biased depressable stops 24 form an abutment for the rear edge of the sheet metal plates 5.

On a first side of the feeding bar or beam 21 which faces the cutters or cutting blades 2, 3 there are arranged elevatable or elevationally displaceable and closable first holding elements or grippers 25, and on a second opposite side of such feeding bar 21 which is located remote from the cutters or cutting blades 2, 3 there are arranged holding elements or grippers 26 which are also elevatable or elevationally displaceable and closable. On the side of the table members 13, 14 which is located remote from the sheet shear or cutting arrangement 1 there is arranged an elevationally displaceable platform 28 which carries a stack 27 of sheet metal plates or panels 5. A supporting structure or framework 28*a* is provided for the elevationally displaceable platform 28 and a stationary connecting bar or beam 29 is connected to such supporting structure. Selectively activatable and vertically adjustable suction elements 30 are secured to the connecting bar or beam 29. Laterally of the stack 27 of the sheet metal plates 5 there is provided a separation magnet 31 for separating individual ones of the sheet metal plates or panels 5 from the stack 27.

Figure 3:
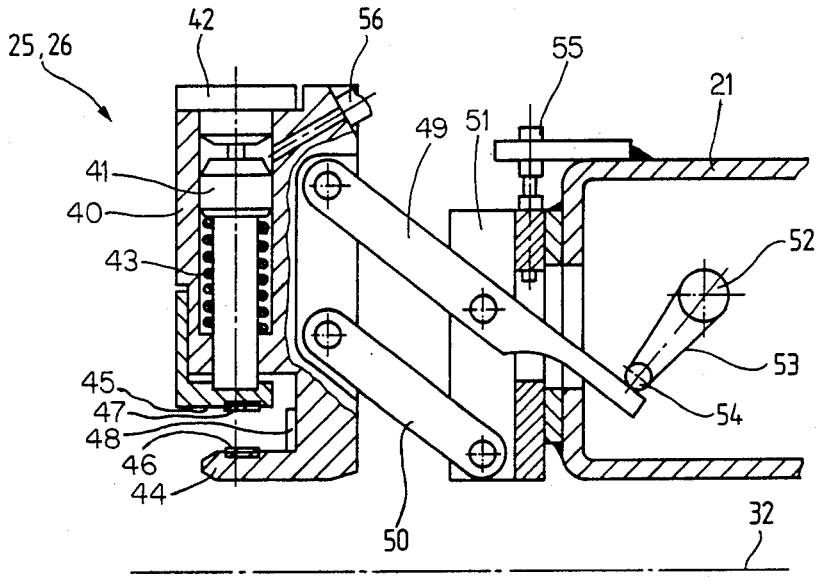
FIG. 3 is a sectional view of a detail of an elevatable or elevationally displaceable holding element used in the apparatus shown in FIG. 1 and depicted in an upper and open position thereof.
Figure 4:
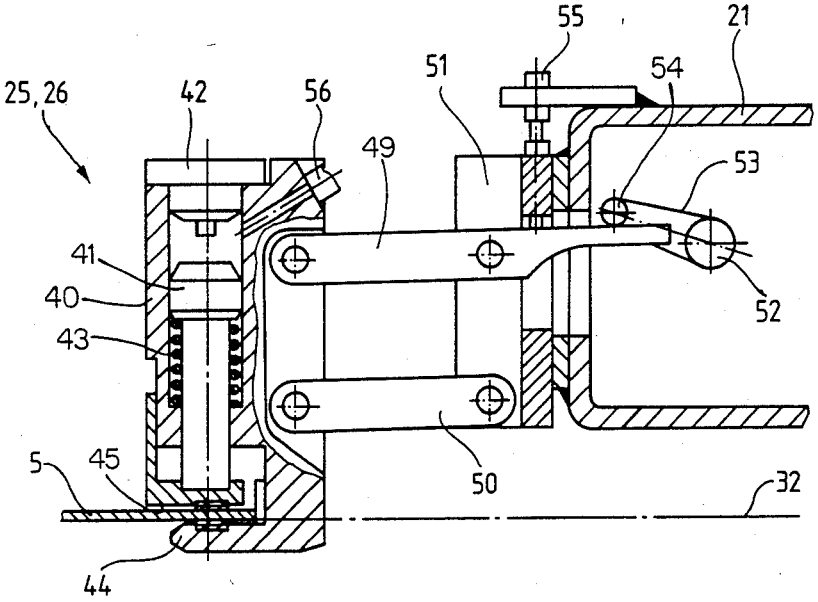
FIG. 4 is a sectional view of the same detail showing as in FIG. 3, with the holding element here shown in its lower and closed position.

FIGS. 3 and 4 show different positions of the holding elements or grippers 25 and 26 mounted to the feeding bar 21. The arrangement of both of the elevationally displaceable and closable holding elements 25 and 26 is practically the same, except that the holding elements 25 are arranged on the side of the feeding bar or beam 21 which faces the sheet shear or cutting arrangement 1 while the other holding elements 26 are arranged on the opposite side of such feeding bar or beam 21 which is located remote from the sheet shear or cutting arrangement 1. Since the design of the holding elements 25 and 26 otherwise is identical, such holding elements are designated in each of FIGS. 3 and 4 by both reference characters 25 and 26. Each one of the holding elements 25 and 26 is connected to the reciprocatable feeding bar 21 for elevational displacement or shifting thereof by means of a parallelogram linkage or guide arrangement comprising an upper rod or link 49 and a lower rod or link 50. A supporting bracket 51 is secured to the feeding bar or beam 21 and supports conventional bearings (not shown) in which the upper rod or rod member 49 and the lower rod or rod member 50 are mounted. The lowermost position of the holding elements 25 and 26 is ensured for by means of an adjustment bolt 55 or equivalent structure. A not particularly illustrated actuation device acts upon the upper rod or link 49 of the parallelogram linkage or guide arrangement via a hollow shaft 52, a roller lever 53 and a roller 54. Each holding element 25 and 26 comprises a gripper element 40 including a contact or bearing finger 44 and a piston-cylinder unit including a piston 41 and a cover member 42 arranged opposite to the contact or bearing finger 44. An elastic insert 46 is arranged at the contact or bearing finger 44 and slightly protrudes therefrom. An adjustable stop or impact member 48 is placed on the rear side of the contact or bearing finger 44. The piston 41 is held in an open position of the holding element by means of a compression spring 43. A bottom or lower surface 45 of the piston or piston arrangement 41 faces the contact or bearing finger 44 and is equipped with a slightly protruding elastic insert or insert member 47. A pressurized fluid medium is conducted into the upper portion of the gripper 40 via a supply line or conduit 56 and serves to displace the piston 41 together with its bottom or lower surface 45 towards the contact or bearing finger 44, so as to assume a closed position, and thus to close the holding element, within which there is gripped a sheet metal plate 5 at its edge or margin. The support or bearing plane upon which the sheet metal plates 5 bear or are supported during their feeding operation is generally designated by reference number 32.

For automatically positioning the sheet metal plates or panels 5 for performing a cutting operation thereat the feeding apparatus as described hereinbefore is advantageously provided with a suitable computerized numerical control known as such. In the starting position the sheet metal plate 5 which is to be cut bears upon the table structure, and specifically may bear upon the table members 13 and 14, so that the rear edge of such sheet metal plate 5 abuts against that part of the depressable or lowerable stops 24 which protrude above the support or bearing plane 32. In this starting position the feeding bar or beam 21 is driven rearwardly to such an extent that the holding elements 25 which face the cutters or cutting blades 2, 3 are positioned to the rear of the sheet metal plate edge which abuts the spring-biased depressable or lowerable stops 24. These holding elements 25 are then located in an upper position above the plane of the sheet metal plate 5 and are held in this position by the driven roller lever 53 (FIG. 3). The piston 41 assumes a position where the holding element 25 is in its open position. When the upper rod or link 49 of the parallelogram linkage arrangement is released by the roller lever 53, then the holding element 25 moves so as to assume its lower or bottom position in which the piston 41 is still in the open position of such holding element and in which the upper surface of the contact or bearing finger 44 projects below the support or bearing plane 32 of the sheet metal plate 5.

When the shearing or cutting operation has been initiated, then the feeding bar or beam 21, which is driven by the transmission drive motor via the pinions 23 meshing with the two toothed racks 20 at the lateral beams 28, is advanced towards the cutters or cutting blades 2, 3 to such an extent that the holding elements 25 in their bottom position with the pistons 41 in their open position arrive in an engagement position for gripping the sheet metal plate 5. Specifically, the reciprocatable feeding bar or beam 21 is advanced until the stop or abutment 48 on the rear side of the contact or bearing finger 44 and the rearmost edge of the sheet metal plate 5 are only spaced from each other by about 1 mm. After a short intermediate stop the displacement of the feeding bar or beam 21 is restarted and during the acceleration phase of this movement the piston-cylinder units of the holding elements 25 are, for instance, pneumatically operated so that the pistons 41 assume their closed positions and now securely hold or grip the sheet metal plate 5. There then follows the preprogrammed trimming and cutting operation of the sheet metal plate 5. In case that a sheet metal plate 5 is completely cut so as to form strips, then the last strip can be automatically ejected to the rear by displacing the feeding bar or beam 21 into an extreme or end position in front of the holddown means or sheet holddown 4 and by simultaneously opening the pistons 41 and elevating the holding elements 25. The sheet metal cuttings or sections are conducted, depending upon their size, via the downwardly pivotable supporting table 6 either to the stacking location or station 7 for larger size sheet metal sections, or directly fall down onto the stacking location or station 8 for small sheet metal strips, when the supporting table 6 and the scrap metal flap 9 are retracted. Waste or scrap sheet metal is directly conducted into the waste or scrap metal container 10, when the supporting table 6 is retracted and the waste or scrap metal flap 9 is in its operative or inserted position.

After cutting-up a sheet metal plate or panel 5 as described hereinbefore, the now empty feeding bar or beam 21 is displaced towards the rear for gripping the next-following sheet metal plate or panel 5. Such next-following or successive sheet metal plate 5 or the like has been automatically placed on the table structures of the sheet feeding apparatus during the cutting operation of the preceding sheet metal plate 5 within an overlapping time interval. To achieve this result the upper or topmost sheet metal plate 5 of the sheet metal plate stack 27, which is placed on the vertically adjustable elevating platform 28 on the side of the working table 12 and the table members 13, 14 located remote from the sheet shear or cutting arrangement 1, is gripped by the suction elements 30 arranged at the stationary connecting bar or beam 29 and lifted at one side at the correct moment of the sheet feeding operation cycle. The position of the elevated sheet metal plate edge after this operation is such that, when the reciprocatable feeding bar or beam 21 is displaced into the starting position, the holding elements 26 which are arranged on the other side thereof remote from the cutters or cutting blades 2, 3 can assume a plate-gripping position extending around the lifted edge of the elevated sheet metal plate 5 in their upper position and with the pistons 41 of such holding elements 26 in their open position. These holding elements 26 automatically grip the newly supplied sheet metal plate 5 in this upper position while the pistons 41 are moved into their closed positions, in order to securely clamp the sheet metal plate 5 between the mutually confronting surfaces at the pistons 41 and the contact or bearing fingers 44. Since the lifted edge of the elevated sheet metal plate 5 does not extend horizontally but is slightly downwardly inclined, there are advantageously provided the slightly protruding elastic inserts 46 and 47, which preferably are made of polyurethane, in the bottom or lower surface 45 of the pistons 41 and in the contact or bearing fingers 44. Such inserts 46 and 47, on the one hand, exert a leveling or stabilizing action between the sheet metal plate 5 and the holding elements 26 and, on the other hand, securely hold the sheet metal plate 5 without forming any permanent markings thereon. For the same reason it is advantageous if the holding elements 25 and 26 can be moved substantially parallel from the upper into the lower position and vice versa. When the pistons 41 of the holding elements 26 have assumed their closed positions, then the suction elements 30 are vented and upwardly withdrawn.

The separation magnet 31 or the like which is arranged laterally of the sheet metal plate stack 27 prevents more than one sheet metal plate 5 from being simultaneously gripped and conveyed. In the case of non-magnetic materials another type of separation device, for example, containing blast or blow nozzles may be provided.

When the cutting operation is initiated, the sheet metal plate 5 which is present on the working table 12 or the table members 13, 14 thereof, respectively, is gripped and displaced by the first holding elements 25 as described hereinbefore. Simultaneously, the new or further sheet metal plate 5 is drawn onto the working table 12 or the table members 13, 14 thereof by means of the other holding elements 26. The computerized numerical control is structured such that the holding elements 26 automatically open as soon as the rear edge of the successively withdrawn sheet metal plate 5 has passed over the depressable or lowerable stops 24. The new or further sheet metal plate 5 thus comes to lie in a position in front of the depressable stops or abutments 24 while the feeding bar or beam 21 is further displaced in order to complete the cutting operation of the preceding sheet metal plate 5. When the feeding bar or beam 21 is rearwardly returned, the holding elements 26 are retained in their lower or bottom position and the pistons 41 thereof in their open position. By means of the computerized numerical control the feeding bar or beam 21 is stopped immediately before the holding elements 26 reach the front side or edge of the new sheet metal plate 5. After a short intermediate stop the holding elements 26 contact the new sheet metal plate 5 and slowly displace the same with its rear side edge towards the spring-biased protruding stops or abutments 24. Suitable and thus not particularly shown monitoring contacts bring about standstill of the feeding bar or beam 21 when the rear plate edge of the sheet metal plate 5 abuts the stops 24. Subsequently, the pistons 41 of the holding elements 26 are displaced into their open position and the feeding bar or beam 21 is advanced in the direction towards the cutter or cutting blades 2, 3 to such an extent that these holding elements 26 are now free of contact with the sheet metal plate and can be automatically elevated into their upper position. Thereafter, the feeding bar 21 with the two groups of elevated holding elements 25 and 26 can be rearwardly retracted so as to pass over the sheet metal plate 5 into the starting position, firstly, so as to be able to grip the sheet metal plate 5 which is located at the region of the stops 24 and, secondly, to grip a further new sheet metal plate 5 from the sheet metal plate stack 27. Inoperative holding elements 25 and 26 can be manually displaced into their top or upper position and held in this position by any suitable arresting means.

Since the manipulation for abutting the rear edge of the sheet metal plate 5 at the stops or abutments 24 interrupts the direct return run of the feeding bar or beam 21 and requires an additional amount of time, there also can be provided driven reverse-displacement rolls at the table structure, such as at the working table 12 which are fixedly arranged thereat. Such sheet metal-reverse displacement rolls or rollers can rearwardly drive the new or further sheet metal plate 5 immediately after the same has been placed on the working table 12 and towards the rear side stops or abuttment 24 while the cutting operation which is being performed upon the preceding sheet metal plate 5 is being completed.

For small cutting series or special sections the inventive feeding apparatus also can be conventionally used for performing manual cutting operations. For this purpose the feeding bar or beam 21 is moved into the end position in front of the sheet metal plate hold-down means 4 and the downwardly pivotable tables 14 are downwardly pivoted or tilted at their hinge connection with the intermediate support 15 by withdrawing the table locking latches or pawls arranged at the stationary tables 13. Packs of springs or the like can be provided below the pivotable tables in order to substantially compensate the weight of the downwardly pivotable tables 14. When the pivotable or tiltable tables 14 are downwardly pivoted there is freed access to the working table 12 and thus to the sheet shear or cutting arrangement 1 at the central region.

Pneumatically operated means are conveniently provided for actuating the pistons 41 and for performing the closing operations of the two holding elements 25 and 26 and for the displacement of the roller lever 53, in order to release the holding elements 25 and 26 for their downward movement into their bottom or lower position. It is, however, readily possible to use hydraulic equipment instead of the aforementioned pneumatically operated means for accomplishing these just-described functions.

While there are shown and described present preferred embodiments of the invention, it is to be distinctly understood that the invention is not limited thereto, but may be otherwise variously embodied and practiced within the scope of the following claims. Accordingly,

What we claim is:

1. An apparatus for feeding sheet metal plates to a sheet shear arrangement, especially a computerized numerically controlled sheet shear arrangement containing cutting blades, comprising:

a working table arranged in front of the sheet shear arrangement;

a feeding bar extending substantially parallel to the cutting blades of said sheet shear arrangement and having a first side facing said cutting blades and a second side located remote from said cutting blades;

drive means for reciprocatingly moving said feeding bar substantially perpendicular to said cutting blades and longitudinally of said working table;

elevationally displaceable first holding elements arranged on said first side of said feeding bar for gripping an edge of a sheet metal plate;

elevationally displaceable second holding elements arranged on said second side of said feeding bar for gripping an edge of a sheet metal plate;

said working table comprising at least two stationary table members and at least one downwardly pivotable table member; and at least one intermediate support with which there is operatively connected said at least one downwardly pivotable table member.

2. The apparatus as defined in claim 1, wherein:

said drive means for reciprocating said feeding bar comprise stationary toothed racks and pinions meshing therewith.

3. The apparatus as defined in claim 1, wherein:

each said first and second holding elements is mounted to be elevatably displaceable at said feeding bar and comprises:

a gripper including a bearing finger;

said gripper being selectively displaceable between an upper position located above the sheet metal plate and a lower position located in a plane of said sheet metal plate;

a piston-cylinder unit including a piston selectively displaceable between an open position and a closed position cooperating with said gripper; and said piston in said closed position thereof engaging with said bearing finger in order to securely clamp said sheet metal plate.

4. The apparatus as defined in claim 3, further including:

a number of parallelogram-linkages operatively connected to said feeding bar;

a number of driven roller levers each operatively associated with one of said parallelogram-linkages for actuating the same; and each gripper of said first and second holding elements being arranged at a respective one of said parallelogram-linkages.

5. The apparatus as defined in claim 4, wherein:

each gripper of said first and second holding elements being holdable in said upper position by means of a related one of said driven roller levers; and each gripper of said first and second holding elements being movable under the action of gravity into said lower position, when released from the action of its related driven roller lever.

6. The apparatus as defined in claim 3, wherein:

said bearing finger has a side facing said piston; and said bearing finger comprises an elastic insert protruding from said side facing the piston.

7. The apparatus as defined in claim 3, wherein:

said piston has a bottom surface facing said bearing finger; and an elastic insert being arranged to protrude from said bottom surface of the piston facing said bearing finger.

8. The apparatus as defined in claim 3, further including:

a spring holding said piston in said open position thereof.

9. The apparatus as defined in claim 3, further including:

arresting means; and said arresting means selectively retaining said first and second holding elements in said upper position thereof when the same are an inoperative position thereof.

10. The apparatus as defined in claim 1, further including:

depressable stops;

said working table having a side located remote from said cutting blades; and said depressable stops being arranged on said side of said working table located remote from said cutting blades.

11. The apparatus as defined in claim 10, further including:

a bearing plane defined for the sheet metal plates;

said depressable stops comprise spring-biased depressable stops in order to raise the same above said bearing plane; and said depressable stops being shiftable to a position beneath said bearing plane under the load of the sheet metal plate.

* * * * *